United States Patent [19]

Milianowicz et al.

[11] 4,149,051

[45] Apr. 10, 1979

[54] ELECTRICALLY CONDUCTING GAS CONDENSER SUPPORT FOR A PUFFER CIRCUIT INTERRUPTER

[75] Inventors: Stanislaw A. Milianowicz, Monroeville; Fred Bould, Edgewood, both of Pa.

[73] Assignee: Westinghouse Electric Corp., Pittsburgh, Pa.

[21] Appl. No.: 791,433

[22] Filed: Apr. 27, 1977

[51] Int. Cl.[2] ..... H01H 33/88

[52] U.S. Cl. ..... 200/148 A; 200/148 R; 200/148 C; 200/148 G

[58] Field of Search ..... 200/148 R, 148 C, 148 A, 200/148 G

[56] References Cited

U.S. PATENT DOCUMENTS

| | | | |
|---|---|---|---|
| 2,733,316 | 1/1956 | Brown, Jr. et al. | 200/148 A |
| 2,748,226 | 5/1956 | MacNeill et al. | 200/148 R |
| 2,757,261 | 7/1956 | Lingal et al. | 200/148 G |
| 2,798,922 | 7/1957 | Lingal et al. | 200/148 G |
| 2,809,259 | 10/1957 | Baker et al. | 200/148 H |
| 2,824,937 | 2/1958 | Strom | 200/148 B |
| 3,852,551 | 12/1974 | Cleaveland | 200/148 A |

*Primary Examiner*—Robert S. Macon

*Attorney, Agent, or Firm*—M. J. Moran

[57] ABSTRACT

A puffer circuit interrupter is taught. Arc extinguishing gas is vented through a hollow stationary arc contact into a gas condenser. The gas condenser is an elongated toroid having a well-defined open central region. The gas condensing portion of the toroid is formed from overlapping layers of wound copper mesh. The elongated central opening of the toroid is aligned with the hollow electrode for receiving the arc quenching gas. At one end of the condenser is an external conductor for the puffer circuit interrupter. At the other end of the condenser is a disc having a central opening therein through which the hollow electrode protrudes. The condenser is thus firmly maintained longitudinally between the disc and the external electrode. Surrounding the circumferential periphery of the condenser and bridging the space between the disc and the electrode are longitudinally disposed circumferentially spaced fingers. The spaced fingers form a support cage for the condenser. Furthermore, the fingers extend longitudinally beyond the disc for making electrical contact with a movable contact in the circuit breaker apparatus. These fingers thus act as the rated current carrying conductors when the circuit breaker apparatus is in the closed state.

7 Claims, 5 Drawing Figures

ELECTRICALLY CONDUCTING GAS CONDENSER SUPPORT FOR A PUFFER CIRCUIT INTERRUPTER

CROSS-REFERENCE TO RELATED APPLICATIONS

This invention is related to those disclosed in copending applications Ser. No. 768,939, Ser. No. 769,139, and Ser. No. 769,140, all of which were filed on Feb. 15, 1977.

BACKGROUND OF THE INVENTION

1. Field of the Invention

The subject matter of this invention relates generally to puffer circuit interrupters, and relates more specifically to supports for gas condensers in circuit breaker apparatus and to current carrying contacts in circuit breaker apparatus.

2. Description of the Prior Art

It has been known for some time to utilize gaseous environments in circuit breaker apparatus. U.S. Pat. No. 2,757,261 issued to Lingal et al on July 31, 1956, U.S. Pat. No. 2,798,922 issued to Lingal et al on July 9, 1957, U.S. Pat. No. 2,809,259 issued to Baker et al on Oct. 8, 1957 and U.S. Pat. No. 2,733,316 issued to Browne et al on Jan. 31, 1956 all teach sulfur hexafluoride gas environments for circuit breaker apparatus. The preceding patents teach a relatively static gaseous environment in which the insulating and arc extinguishing qualities of sulfur hexafluoride gas are utilized. U.S. Pat. No. 2,824,937 issued to A. P. Strom on Feb. 25, 1958 and U.S. Pat. No. 2,748,226 issued to MacNeill et al on May 29, 1956 teach the utilization of a blast or flow of sulfur hexafluoride gas for extinguishing an arc. Recently, puffer type compressed gas circuit interrupters have been taught, such as by U.S. Pat. No. 3,852,551 issued Dec. 3, 1974 to C. M. Cleaveland. In the latter case, a piston is mounted internally to an elongated circuit breaker apparatus to operate in conjunction with the operating mechanism for the contacts of the circuit breaker apparatus to provide a puff or jet of gas to the region of the arc during the contact opening operation of the circuit breaker. It is known to use gas condensers with circuit breaker apparatus. The condenser takes the heated gas from an arc extinguishing operation and cools it thus condensing water out of it and reducing its pressure and temperature. The gas is then vented to other portions of the circuit breaker apparatus at reduced pressure and reduced temperature for containment. In the past, the condenser or gas cooler, as it is sometimes called, was contained within a cylindrical shell which had holes disposed therein for venting the exit gas from the condenser to the region of containment. The holes, however, provided regions of greatly restricted gas passage. In addition, the bulk of the condenser enclosure represented a significant amount of metal since the holes represented only a relatively few openings therein. Furthermore, the condenser was formed of one single piece of material requiring a relatively complex manufacturing operation. Typically, the condenser had to be cut, machined, and drilled. Furthermore, the condenser was usually interconnected with flexible fingers which acted as the main contact fingers for the circuit breaker apparatus. The load current flows through the fingers and into the main body of the condenser enclosure where it flows past the holes toward the main terminal. It would be advantageous if a condensing support arrangement could be found which combined the support capabilities of the drilled condenser and the current carrying capabilities of the flexible fingers. It would be further advantageous if the condenser would be formed from a number of similar parts so that if one of the parts was defective or otherwise rendered inoperable, only that part would have to be replaced rather than the entire condenser. It would be further advantageous if the gas venting characteristic of the condenser enclosure was enhanced by the utilization of more openings and by the distribution of the pressure and heat dissipating characteristics thereof.

SUMMARY OF THE INVENTION

In accordance with the invention, a puffer circuit breaker apparatus is taught which includes a single, elongated cylindrical barrel upon which external electrical terminals are disposed in electrically conducting relationship with internal separable contacts. The internal portion of the barrel is generally sealed against the outside environment. Two cylindrical hollow conductors are provided, one of which is fixed and the other of which is movable in conjunction with an operating mechanism. When the circuit breaker apparatus opens, an arc is drawn between the separating hollow conductors. Gas which may be provided by a puffer is supplied to the latter region to cool and extinguish the arc. Naturally, the gas becomes heated as it cools the arc. The heated gas is passed through the fixed hollow conductor to a central opening in an elongated toroidally shaped condenser. The condenser is held in place longitudinally at one end by the internal portion of one of the external main terminals. The condenser is held in place at the other end by a disc which has an opening therein through which the hollow tubular conductor communicates with the central region of the toroidally shaped condenser. Connected to the aforementioned interal portion of the external terminal are fingers which are spaced regularly around a circular lip on the terminal and which bridge the space between the external terminal and the aforementioned disc. The disc has a circular periphery which is complementary to the circular lip on the external terminal. It is on the lip and the disc that the briding fingers are secured. This forms a cage-like structure around the enclosed toroidally shaped condenser. The spaces between the slats of the fingers provide openings through which the gas which has been subjected to the condensing action of the condenser passes. Each of the fingers is extended beyond the disc in a cantilevered fashion to form a flexible fingered main contact for the circuit breaker apparatus. This main contact arrangement interconnects with a part of a movable contact when the circuit breaker is closed.

BRIEF DESCRIPTION OF THE DRAWINGS

For a better understanding of the invention, reference may be had to the preferred embodiment thereof shown in the accompanying drawings, in which.

DESCRIPTION OF THE PREFERRED EMBODIMENTS

Figure 1:
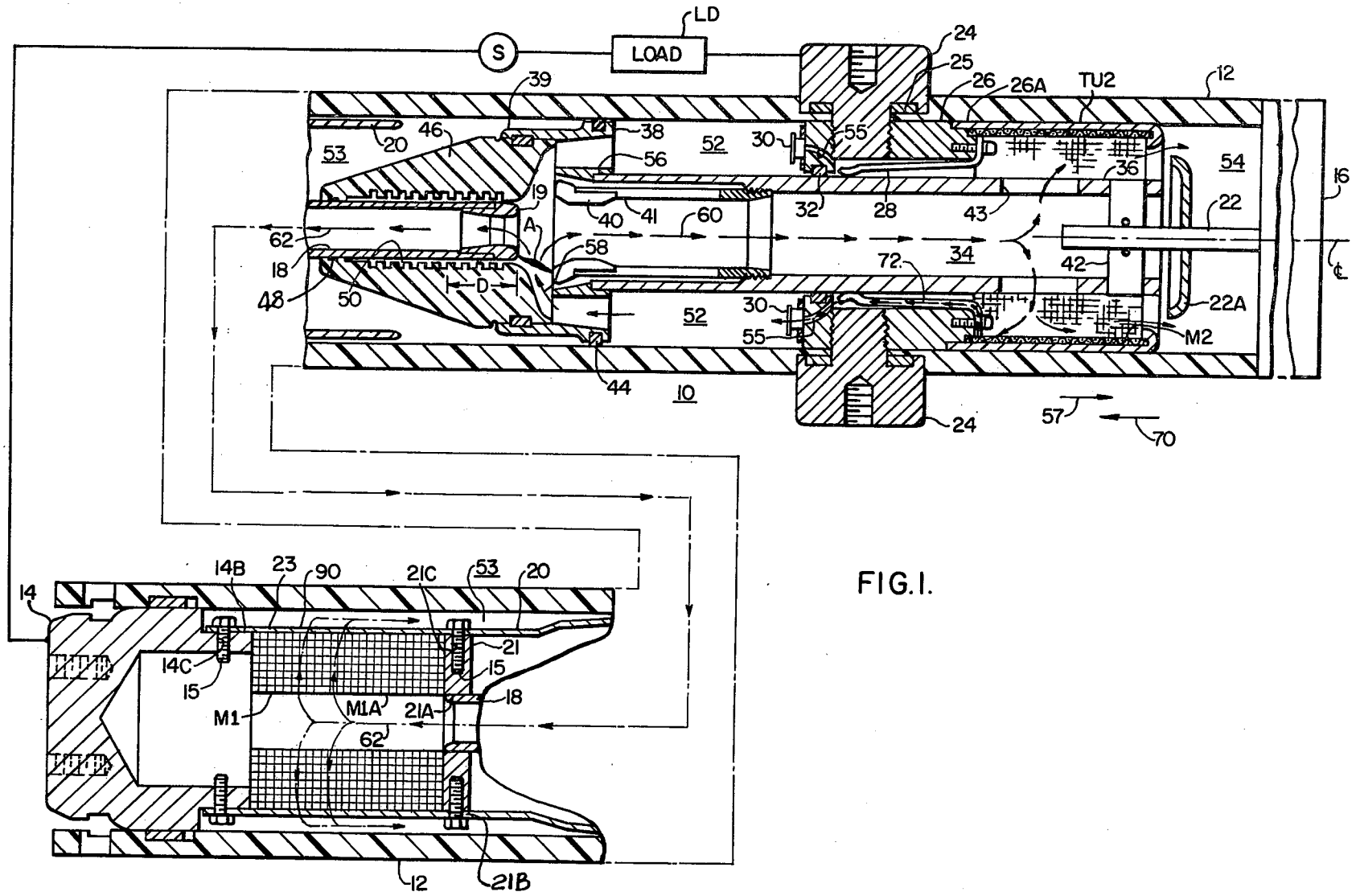
FIG. 1 shows a puffer circuit breaker apparatus partially in section, partially broken away, and partially in block diagram form.
Figure 5:
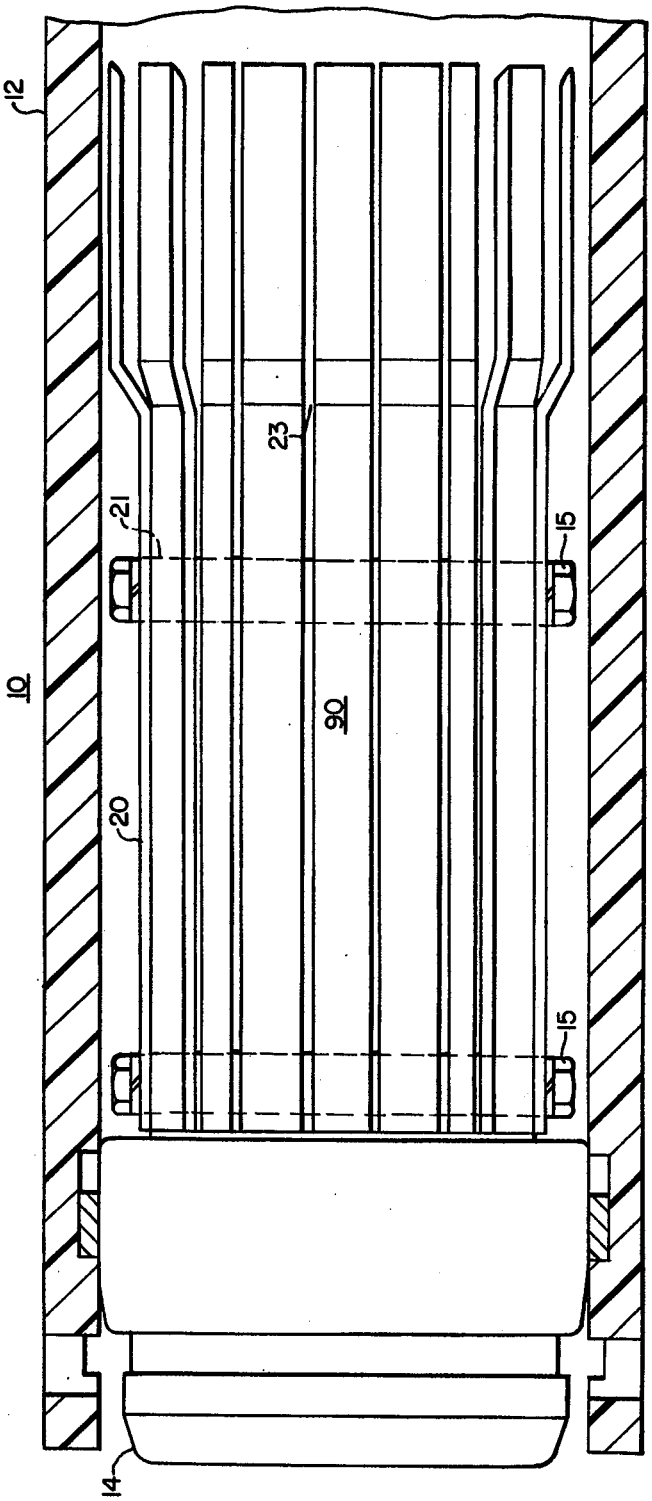
FIG. 5 shows a broken away portion of the apparatus of FIG. 1 where only the insulating tube is shown in section and where the main contact and condenser support cage are shown in full elevation.

Referring now to the drawings and FIGS. 1 and 5 in particular, a single tube puffer circuit interrupter 10 is shown. The puffer circuit interrupter or circuit breaker 10 may include a hollow cylindrical insulating support tube 12. Support tube 12 has an electrically conducting terminal 14 disposed on the left portion thereof and has an operating mechanism 16 on the right portion thereof as viewed in FIG. 1. The insulating support tube 12 may be radially symmetrical about a centerline CL. A hollow, generally cylindrical electrical conductor 18 is shown in the left portion of circuit breaker apparatus 10 as viewed in FIG. 1. The hollow conductor 18 is interconnected electrically with the terminal 14 primarily through a conducting disc 21 and flexible main conducting fingers 20, the use of which will be described in detail hereinafter. At the right end of the hollow electrical conductor 18 as viewed in FIG. 1 is an arcing contact piece 19 which may comprise any suitable electrically conductive material which will withstand arcing for a relatively long period of time and for many operations. Interconnected with the operating mechanism 16, shown schematically to the right of FIG. 1, is a movable connecting rod 22, the use of which will be described more fully hereinafter. Disposed on either side (top and bottom as viewed in FIG. 1) of the electrically insulating support tube 12 may be electrically conducting terminals 24. Each electrically conductive terminal 24 may be seated and sealed in an appropriate groove or seat 25 in the insulating support member 12. A portion of the electrically conductive terminal 24 protrudes through the insulating support tube 12 and is threaded into an internal connector and support piece 26 for securing the terminal 24 against the inside wall of the insulating support tube 12 in electrically conducting relationship with the internal conductor 26. Disposed on the internal conducting member 26 may be a plurality of electrically conducting flexible fingers 28 and aat least one unidirectional gas valve 30. The use of the latter two elements will be described more fully hereinafter. Also disposed on the internal conducting member 26 may be a seal 32. The use of the seal 32 will be described more fully hereinafter with respect to other portions of the apparatus. A cooler tube TU2 is interlocked against the inside wall of the support tube 12 at 26A on the support piece 26. The use of tube TU2 will be described more fully hereinafter.

There is provided a movable electrical contact assembly 34 which includes a generally cylindrical hollow electrically conducting tube member 36. The electrically conducting tube member 36 may be radially disposed symmetrically about the previously-described centerline CL. Disposed at the left end of the electrically conducting movable tube member 36 is a conducting flange 38 having an extended electrically conducting portion 39 which is adapted to make sliding electrical contact with the previously described main contact fingers 20 when the puffer circuit breaker 10 is closed. Also disposed on the left portion of the hollow conductive tube member 36 may be flexible contact fingers 40 which are complementary to the contact piece 19 described previously. On the right portion of the electrically conducting hollow cylindrical tube 36 is disposed a yoke 42 which is mechanically interconnected with the connecting rod 22 such that movement of the connecting rod 22 in the direction 70 in response to an appropriaate action in the operating mechanism 16 will cause the entire body of the hollow conducting tube member 36 to move to the left to thus place the arcing contact fingers 40 in a disposition of overlapping electrical contact with the arcing contact 19 and to place the extended portion 39 of the conducting flange 38 in a disposition of electrical contact with the main contact fingers 20. It is to be noted that in this particular embodiment of the invention the relative longitudinal disposition of the contact fingers 20, the extended portion 39, the contact piece 19, and the contact fingers 40 is such that electrical contact is made during a circuit breaker closing operation between the contact piece 19 and the contact fingers 40 before electrical contact is made between the contact fingers 20 and the extended portion 39. Likewise, in an opening operation, the contact fingers 20 and the extended portion 39 separate before the contact piece 19 and the contact fingers 40 separate. The amount of overlap between fingers 40 and contact 19 is represented by the distance D. The fingers 40 are joined at one end thereof so that the inner regions of tubes 18 and 36 are sealed from chamber 52 when the circuit breaker 10 is in the closed state. There is provided a seal 44 on the outer portion of the contact flange 38. The seal 44 operates against the inner surface of the insulating support tube 12 to thus locally isolate two gas pressure regions which will be described hereinafter. In a like manner, the previously described seal 32 operates against the hollow conducting tube 36 to locally isolate one of the previously described gas pressure regions from a third gas pressure region. There may be disposed to the right of the electrically conducting cylinder 36 an opening 42 which provides communication between the internal portion of the hollow conducting tube 36 and the region surrounding the external portion of the hollow conducting tube member 36 to the right of the seal 32 as viewed in FIG. 1. There is provided an arc nozzle 46, the right portion of which is disposed on the previously descriged conducting flange 38. Nozzle 46 is supported at the left portion thereof in sealed but movable relationship against the outer surface of the previously described hollow conductor 18. The seal 48 cooperates with the previously described seal 44 to provide the first two previously described regions of differential gas pressure during the operation of the circuit interrupter apparatus 10. In a preferred embodiment of the invention, nozzle 46 always remains in sealed relationship with tube 18 thus providing an arc shield between the arcing contacts 19 and 40 and the inner surface of wall 12 during an arcing operation. On the internal portion of the arc nozzle 46 may be disposed a corrugated or ridged region 50 which provides high arc tracking resistance during the circuit breaker opening operation.

Figure 2:
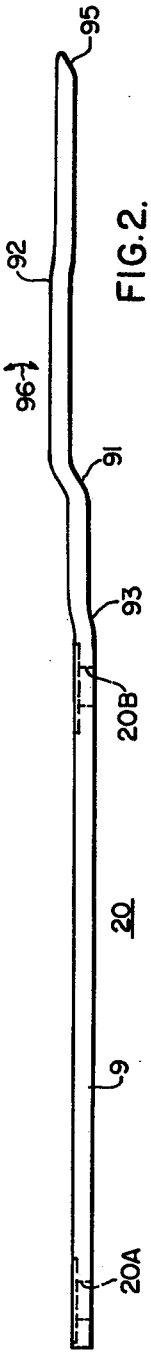
FIG. 2 shows a side view of an elongated electrically conducting finger.
Figure 3:
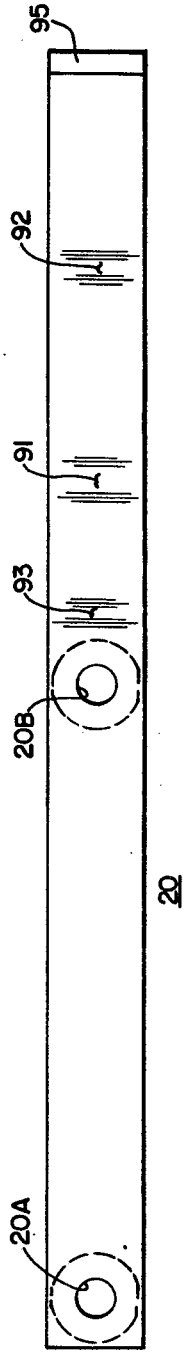
FIG. 3 shows a top view of the finger of FIG. 2.

There is provided a first gas pressure region 52 which may exist between the seals 32 and the seals 44 and 48. Gas pressure is built up in the region 52 during a circuit breaker opening operation as will be described more fully hereinafter. A second gas pressure region 53 may exist between the left end of the circuit breaker apparatus 20 and the combined seals 44 and 48. As best seen in FIG. 5 and FIG. 1, elongated openings 23 between fingers 20 provide paths of communication between the latter region 53 and the internal portion of the hollow conductor 18. A third gas pressure region 54 may exist in the right portion of the circuit breaker apparatus between the seal 32 and the right side of the circuit breaker apparatus 10. The previously described opening 43 provides a path of gas communication between the internal portion of the hollow conducting tube 36 and the region 54. All of the latter described gas pressure regions contain gas of relatively different pressure during certain portions of the operating cycle of the circuit breaker 10. The pressure in each case is related to the relative sizes of openings 23 and 43 for example. The relative differential gas pressure in the latter-named regions 52, 53 and 54 during opening and closing of the circuit breaker apparatus 10 provides the puffer action which will be described hereinafter. There is provided in the conducting flange 38 in opening 56 which communicates with the previously described region 52 and with the internal portions of both of the hollow conducting members 18 and 36. The communicating path previously described is conveniently located such that the contact fingers 40 and the contact piece 19 are disposed therein during a circuit breaker opening or closing operation. The previously described flexible fingers 28 provide a path of electrical conduction between the movable hollow conductive tube 36 and the internal conductor 26. A source of electrical power S may be serially or otherwise connected with a load LD which is to be protected by the circuit breaker apparatus 10. Such an arrangement is shown schematically in FIG. 1. The latter serial arrangement is interconnected with the terminal 14 and the terminal 24. By viewing FIG. 1 and FIG. 5, it can be seen that the stationary tube 18 is attached to and feeds through a central complementary circular hole or opening 21A in the circular disc 21. In a preferred embodiment of the invention, the circular disc 21 is electrically conducting copper or aluminum material, which is brazed or otherwise securely fastened to the hollow conducting tube 18. The elongated fingers 20, which will be more fully described with respect to FIGS. 2 and 3, are secured at one end in an electrically conducting relationship to a lip 14B on an internal part of the external terminal 14. Each elongated finger 20 is similarly secured in a central region thereof to the outer periphery of the circular disc 21. The finger 20 is secured to the terminal 14 by way of a threaded bolt 15 disposed in a complementary threaded hole 14C in the lip 14B. Likewise, the finger 20 is secured to the disc 21 by way of a threaded bolt 15 in a complementary threaded hole 21C in the disc 21. Finger 20 extends to the right as viewed in FIG. 1, in a cantilevered fashion. The fingers 21 are relatively flexible in this region and are utilized to make contact with the movable conductor extended portion 39 as described previously. A plurality of the fingers 20 are peripherally spaced around the lip 14B and the disc 21 to form a cage 90 in which the downstream gas cooler or condenser M1 is snugly secured. Cage 90 is best shown in FIG. 5. Gas, which may follow a path 62 for example, flows longitudinally into a central opening M1A in the toroidal condenser M1 where it diffuses radially through the cooling tube and out of the cage through the openings 23 into the pressure region 53. The path of gas flow may be typified as is shown in FIG. 1 for example. In a like manner, cooling tube TU2 encloses a cooling mesh M2 through which hot gas following path 60 may be diffused laterally by way of opening 43. In the latter case, a deflector 22A is positioned on rod 22 to aid in channeling a portion of the gas in path 60 into the mesh M2 for lateral diffusion therethrough.

OPERATION OF CIRCUIT BREAKER APPARATUS 10

During the closing operation of the circuit breaker apparatus 10, the connecting rod 22 forces the hollow conducting tube 36 to the left as viewed in FIG. 1. Electrical continuity is maintained between the terminals 24 and the moving conducting cylinder 36 by way of the internal conductor or connector 26 and the fingers 28. As the cylinder 36 moves to the left, the flange 38, the nozzle 46 and the contact fingers 40 also move to the left. The movement of the flange 38 to the left causes the volume of the region 52 to enlarge, thus creating a local short term pressure differential between region 52 and regions 53 and 54 taken together such that gas from region 54 moves through valve 30 by way of a channel 55 along the path 72 to region 52. Gas from regions 53 and 54 may also move into region 52 by way of opening 56 until portion 41 of fingers 40 overlaps contact 19 thus closing off orifice 56 from regions 53 and 54. This charges region 52 with puffer gas ($SF_6$ for example) during the circuit breaker closing operation, it being understood that the unidirectional valve 30 opens to pass gas only in the direction 72 and closes to prevent gas from passing therethrough in the opposite direction. As the movable contact assembly 34 continues movement to the left, a position is reached where the contact fingers 40 make electrical contact with the contact piece 19 on the hollow conductor 18. A short time thereafter the extended contact region 39 makes electrical contact with the main contact fingers 20. In this position the circuit which includes the load LD and the source S is closed through the puffer circuit breaker 10.

In a contact opening operation the connecting rod 22 moves in the direction 57, thus causing the hollow conductive tube 36 of the movable contact assembly 34 to move to the right. The main contact fingers 20 and the extended contact region 39 of the conducting flange 38 disengage first. Movement of the flange 38 and nozzle 46 in the direction 57 through the distance D forces the trapped gas in the region 52 to become pressured by the reduction in volume in region 52. The latter movement through the region D is sometimes referred to as "lost motion" movement. Eventually a point is reached during the contact opening cycle where the contact piece 19 of the generally stationary hollow conductor 18 and the contact fingers 40 of the movable contact assembly 34 disengage under load or overload current or the like, thus generating an arc A. The pressurized gas in region 52 follows path 58 through opening 56 and is puffed or forced into the region of the arc A for quenching and cooling the arc A and for blowing the arc A out from between the contact piece 19 and the contact fingers 40. As mentioned previously, the heated gas may then follow path 62 into the hollow conductor 18, radially through the cooling mesh M1, through the elongated openings 23 of the support cage 90 and into the region 53. Alternatively or concurrently, the heated gas may follow the path 60 through the internal portion of the cylinder 36 and out through the holes 43 to be diffused laterally of the center line CL through the mesh M2 and into the region 54. The relation between the diameter of the orifice through the contact 19, the internal diameter of the tube 12, and the velocity of the piston 38 are chosen so that the volume of space 53 increases appreciably faster than gas can flow into the space through the central orifice of the contact piece 19. The result is a reduction in gas pressure in the space 53 and an increase in the pressure drop across the central orifice of the contact 19, which increases interrupting ability.

After the arc A has been extinguished, the movable contact assembly 34 continues movement to the right in the direction 57 until a stable opened position is reached. The puffer circuit breaker apparatus 10 is, in this position, ready for a closing or reclosing operation. The pressure in the three gas regions 52, 53, 54 eventually becomes equalized if such has not occurred earlier in the opening cycle.

Figure 4:
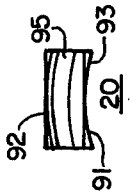
FIG. 4 shows a front view of the finger of FIG. 2.

Referring now more specifically to FIGS. 2, 3, and 4, an elongated finger member 20 is shown. Finger member 20 may comprise anodized aluminum or similar electrically conducting material. It will be noted that the finger member 20 is offset at the region 91. This has the property of increasing the relative diameter of the cage member from the diameter of the disc 21 shown in FIG. 1 to the diameter of the conductor member 39 also shown in FIG. 1. Furthermore, the finger member 20 is rolled or given a slight arcuate cross-section at 92 and 93. This allows the member 20 to be seated or attached firmly with a great deal of surface contact at the lip **14*b* and the outer circumference 21B of the disc 21 shown in FIG. 1. Furthermore, it allows the contact resistance between the movable contact 39 and the finger 20 to be relatively low when the circuit breaker apparatus is closed. The holes 20A and 20B are depicted in FIGS. 2 and 3. It will be noted that because of the gentle roll previously described, flat machined surfaces 94 for the bolt holes 20A and 20B are required for the member 20. This allows the relatively flat surface of the underside of the head portion of the bolt 15 to make secure contact with the member 20 when it is fully assembled into the cage 90 shown in FIGS. 1 and 5. It will be also noted that the leading edge of the member 20 has a bevel 95 therein for mating with the leading edge of the contact extended member 39 as the circuit breaker apparatus 10 is closed. It is envisioned that the member 20 will flex in the direction 96 as contact with member 39 is made and broken. The pivot point of the flexure direction 96 is approximately at the hole 20B. This is due to the placement of the bolt 15 into the disc 21 as shown in FIG. 1**.

It is to be understood with respect to the embodiments of this invention that the relative spacing of the openings 23 may vary according to the current carrying capability of the members 20 and the desirous gas discharge rate from the condenser M1 into the region 53. It is also to be understood that a member 20 need not necessarily be composed of aluminum but may be composed of any other material which has the suitable flexibility and current carrying capabilities. It is also to be understood that the method of attachment of the finger 20 to the lip 14B and the disc 21, for example, need not necessarily be limited to the use of a bolt 15. It is also to be understood that the disc 21 may comprise any suitable current carrying member. It is also to be understood that the composition and form of the gas cooler M1 is not limiting provided it can be held in place by the constraining members: disc 21, terminal 14, and finger members 20. It is also to be understood that it is not necessary that the arrangement as depicted in FIGS. 1 and 5 be limited to the stationary contact but may be applied to a movable contact if other suitable structural accommodations are made.

The apparatus taught with respect to the embodiments of this invention have many advantages. One advantage lies in the fact that a more even distribution of exiting gas from the condenser M1 to the region 53 may occur because of the presence of the elongated generally rectangularly shaped openings 23. Another advantage lies in the fact that the finger member 20 provides the dual function of forming part of the cage or support 90 in which the condenser member M1 is held and providing electrical conductivity when the circuit breaker apparatus 10 is closed. Another advantage lies in the fact that the conducting cage 90 may be disassembled and reassembled for maintenance or the like by removing one finger 20 at a time or by removing a significantly larger number of fingers 20. Such being the case, the entire condenser member M1 may be removed without further disassembling the puffer circuit breaker apparatus 10.

What we claim as our invention is:

1. A circuit interrupter, comprising:

(a) insulating tube means having first and second spaced external electrical terminal means thereon, said external terminal means communicating with the internal portion of said tube means;

(b) first electrical arc contact means disposed within said tube means in a disposition of electrical contact with said first external terminal means;

(c) second electrical arc contact means disposed within said tube means in a disposition of electrical contact with said second external terminal means, said first and said second arc contact means being separable;

(d) a plurality of electrically conducting finger means disposed within said tube means in a disposition of electrical contact with said first external terminal means for forming a gas condenser means support cage;

(e) gas condenser means supported within said support cage for condensing liquid material out of gas as said gas passes therethrough;

(f) gas forcing means for providing arc effecting gas to an arc region between said first and said second arc contact means as they separate, said gas being exited from said arc region through said condenser means; and (g) mean internal electrically conducting contact means disposed within said tube means in a disposition of electrical contact with said second external terminal means, relative motion between said main internal contact means and said finger means assisting in causing the making and breaking of electrical continuity between said first and said second external terminal means, said finger means and said main internal contact means conducting substantially more current between said external terminal means when in a closed state than said arc contact means conduct.

2. The combination as claimed in claim 1 wherein said finger means are spaced laterally around an internal portion of said first external terminal means to provide gas vent paths from said condenser means to another region internal of said tube means.

3. The combination as claimed in clam 2 wherein said finger means are circumferentially spaced, thus forming a cylindrical support cage.

4. The combination as claimed in claim 3 wherein said condenser means is substantialy cylindrical in cross section with an outer diameter substantially equal to the inner diameter of said support cage for thus being snugly supported therein.

5. The combination as claimed in claim 4 wherein said condenser means comprises wound screen material having an axial central opening, said exited gas from said arc region flowing generally axially into said central opening and then radially passing through said condenser means and said gas vent paths between said finger means.

6. The combination as claimed in claim 5 comprising an electrically conducting circular disc having a central hole passing therethrough, said disc being disposed in said support cage, said finger means being attached thereto, said condenser means being thus disposed within a vented enclosure comprised of said disc at one end, said internal portion of said first external terminal means at the other end and said circumferentially spaced finger means around the outer peripheral surface thereof, said exited gas entering said central opening of said condenser means through said central hole of said disc.

7. The combination as claimed in claim 6 wherein said first electrical arc contact means comprises a hollow tube fit into said hole in said disc, said exiting gas from said arc region passing first through said hollow tube, said tube being in electrical contact with said first external terminal means through said disc and said finger means.

* * * * *